US006955415B2

(12) United States Patent
Koblinger et al.

(10) Patent No.: US 6,955,415 B2
(45) Date of Patent: Oct. 18, 2005

(54) PRINTING DEVICES WITH A PLURALITY OF PRINT HEADS AND METHOD FOR USING A PRINTING DEVICE

(75) Inventors: Michael Koblinger, Kolitzheim (DE); Karl Erich Albert Schaschek, Thüngen (DE); Georg Schneider, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 77 days.

(21) Appl. No.: 10/415,654

(22) PCT Filed: Oct. 15, 2001

(86) PCT No.: PCT/DE01/03943

§ 371 (c)(1),
(2), (4) Date: May 7, 2003

(87) PCT Pub. No.: WO02/40278

PCT Pub. Date: May 23, 2002

(65) Prior Publication Data

US 2004/0032453 A1 Feb. 19, 2004

(30) Foreign Application Priority Data

Nov. 17, 2000 (DE) ..... 100 57 062
Nov. 17, 2000 (DE) ..... 100 57 061

(51) Int. Cl.[7] ..... B41J 2/135
(52) U.S. Cl. ..... 347/44; 347/42
(58) Field of Search ..... 347/44, 5, 9, 42, 347/41, 40, 56, 54, 61, 77, 47

(56) References Cited

U.S. PATENT DOCUMENTS

| | | | | |
|---|---|---|---|---|
| 4,864,328 | A | * | 9/1989 | Fischbeck |
| 4,922,271 | A | * | 5/1990 | Nilsson et al. |
| 5,719,602 | A | * | 2/1998 | Hackleman et al. |
| 6,048,048 | A | * | 4/2000 | Gregoire |
| 6,183,063 | B1 | * | 2/2001 | Bolash et al. ..... 347/42 |
| 6,217,148 | B1 | * | 4/2001 | Adler et al. ..... 347/41 |

FOREIGN PATENT DOCUMENTS

| | | | | |
|---|---|---|---|---|
| DE | 37 30 844 | A1 | * 3/1989 | |
| DE | 38 12 462 | A1 | * 10/1989 | |
| DE | 40 20 129 | A1 | * 1/1992 | |
| EP | 0 988 968 | A1 | * 3/2000 | |
| EP | 1 033 254 | A2 | * 3/2000 | |
| GB | 2 349 607 | A | * 1/2000 | |
| WO | WO 94/11191 | | * 5/1994 | |
| WO | WO 97/31781 | | * 9/1997 | |
| WO | WO 00/64680 | | * 4/2000 | ..... B41J/2/145 |

* cited by examiner

*Primary Examiner*—Manish S. Shah
(74) *Attorney, Agent, or Firm*—Jones Tullar & Cooper PC

(57) ABSTRACT

A printing device comprises a plurality of print heads with a large number of nozzle orifices. The print head are arranged in a fixed manner during printing. The nozzle orifices are arranged over the entire maximum width of the material to be printed. The printing device facilitates the modification of a coating on a printing block.

25 Claims, 2 Drawing Sheets

PRINTING DEVICES WITH A PLURALITY OF PRINT HEADS AND METHOD FOR USING A PRINTING DEVICE

FIELD OF THE INVENTION

The present invention is directed to printing devices having a plurality of print heads and to the use of a printing device. Each print head has a plurality of nozzle openings. These are positionable in at least two positions.

BACKGROUND OF THE INVENTION

The printing device is provided with a plurality of print heads, each of which has a printing area whose extension in the printing direction fixes a line height, and whose extension transversely to the printing direction fixes a column width. The print heads are arranged in several parallel rows spaced apart from each other. The print heads of different rows are offset transversely to the printing direction in respect to each other.

The term "print direction" in this context means the movement direction of the material to be imprinted relative to the print heads. If printing plates mounted on rotating printing plate cylinders are provided as the material to be imprinted, the print direction extends perpendicularly in respect to the axis of rotation of the printing plate cylinder and tangentially in relation to its surface.

Printing devices of this type are utilized for placing images on printing plates, for example. A coating material, or as the inverse thereof, a solvent for dissolving a coating of the printing plate, can be sprayed on the printing plate by the use of the plurality of print heads.

In order to obtain a printed image of high quality, it is desirable to be able to supply the medium to be applied to the printing plates finely and in an evenly distributed fashion to each area of the printing plate without missing any spots. For this purpose, the print heads must be aligned in relation to each other sufficiently closely and with an accuracy of a few $\mu$m. On the other hand, the possible density of packing the print heads close to each other is limited, since they touch each other. It would therefore be desirable to be able to function with as few print heads as possible.

However, conventional print heads do not have any surfaces along which they could be aligned by the use of suitable stops. In order to position such print heads in relation to a desired spot it is therefore necessary to compare the actual position of the print image with the desired position of the print image and to then displace the print heads accordingly.

U.S. Pat. No. 5,719,602 shows an ink jet print head with a multitude of nozzle groups. These nozzle groups are arranged offset in respect to each other.

DE 37 30 844 A1 discloses a matrix ink printer, wherein several print heads, each with several nozzle openings, are arranged offset in relation to each other. In this device, the nozzle openings overlap in relation to the material to be imprinted.

GB 2 349 607 A shows a printing device with a plurality of print heads which are arranged offset in respect to each other. These print heads are arranged inclined in the radial direction in relation to a printing cylinder.

U.S. Pat. No. 4,864,328 shows an ink jet print head with several rows of nozzles. These nozzles are inclined in respect to the printing direction.

U.S. Pat. No. 6,048,08 describes a printing device, whose print heads are stationary during the printing operation, but are positioned in respect to each other for adjustment.

A printing device of the width of a page with several print heads is known from WO 00/64680.

EP 0 998 968 A1 discloses an ink jet for changing a coating on a printing forme.

SUMMARY OF THE INVENTION

The object of the present invention is based on providing printing devices with a plurality of print heads and a method for using a printing device.

In accordance with the present invention, this object is attained by providing a printing device having a plurality of print heads, each with a multiplicity of nozzle openings. The print heads are stationary during the print process. They can be positioned in at least two positions transversely to the direction of a running material to be printed. These two positions have a maximum spacing of 50 $\mu$m. The printing device can be used to change a coating on a printing forme. Each print head has a printing area. An extension of this printing area in the printing direction fixes a line height. The extension transverse of the printing direction fixes a column width. The print heads are spaced in several parallel rows with the print heads in different rows being offset transversely to the printing direction.

The advantages which can be obtained by the present invention reside, in particular, in that the dividing distance of the print heads in respectively one print head row corresponds to the column width times the number of rows, and the distance of the rows from each other corresponds to the line height times the number of rows increased by one. The column jumps in a print head row correspond to the number of print head rows, while the line jumps between adjoining print head rows are greater by one than the number of print head rows in the printing device. The print heads are arranged with such accuracy that no gaps and no overlaps between the print heads in areas where no printing, or double printing would occur, are provided. Accordingly, a high resolution can be achieved while also providing a printing device having a compact construction.

In an advantageous manner, the print heads of several rows are arranged in a common plane. A particular print head located in one row can lie on a common plane with respect to a particular print head in every other row. The assembly of the individual print heads is made considerably easier. They can, in particular, be fastened on a level print head holder. Besides a compact arrangement, it is possible, in accordance with the present invention, to achieve a simple alignment capability of the print heads in relation to each other.

In a further development of the present invention, the individual print heads may be arranged obliquely in respect to the print direction in order to achieve a higher resolution. Each printing head has a longitudinal direction which is determined by its print area, or by the line along which the nozzle openings are arranged. The print heads are arranged obliquely with respect to the print direction in such a way that the longitudinal direction of each print head extends at an acute angle to the print direction. The angle can be matched to the existing circumstances, in particular to the shape of the print heads. In accordance with an embodiment of the present invention, the angle can lie between 20° and 45°, and in particular is approximately 30°.

In accordance with a further development of the present invention, the print heads from the different rows can be placed obliquely by the same angle. In particular, they can be arranged in such a way that the longitudinal directions of the print heads of different rows lie on a common plane. The common plane is inclined in relation to the print direction by the same angle by which the print heads are placed obliquely to the print direction.

Further advantages of the present invention reside, in particular, in that, instead of displacing the print head in two axes for appropriately adjusting the print image sprayed by the print head on the material to be imprinted, the alignment of the print head, or of its print image, can be achieved more simply by a combination of a mechanical alignment of the print head in one axis and by a time control of the shot of the print head. Thus, for aligning the print head transversely in respect to the printing direction, the print head is moved, while for aligning the print head in the printing direction, the timing of the shot of material from the print head is changed. The term print direction in this context is again meant to be the movement direction of the material to be imprinted relative to the print heads. If printing plates mounted on rotating printing plate cylinders are provided as the material to be imprinted, the print direction extends perpendicularly in respect to the axis of rotation of the printing plate cylinder. The change in the time of the shot is usefully made as a function of the print speed, i.e. the running speed of the material to be imprinted. If the time of the shot from the print head, is delayed, the material to be imprinted passes farther underneath the print head and vice versa, so that an adjustment of the printed image in the printing direction is achieved.

Several print heads of a multiple head printer can, in particular, be aligned with each other. At least one of the print heads can be displaced for the alignment of the print heads transversely to the printing direction. In addition, or alternatively, for the alignment of the print heads in the printing direction, the time of the shot from at least one print head can be controlled. The displacement, as well as the change of the time of the shot, can be performed individually for each print head, or possibly also for groups of print heads together.

The print heads are advantageously displaced along one axis. They are moved exclusively to accomplish an alignment of the printed image transversely to the printing direction. The adjustment of the print heads, and of the printed image is considerably simplified by this. When performing a displacement of the print heads in only one direction, it is not necessary to keep in mind that a displacement of the printed image in the other axis could possibly also occur. The displacement of the printed image in the other axis is adjusted by the control of the time of the shot.

Preferably all of the print heads which are displaced are displaced in the same direction, i.e. along parallel axes. This simplifies the alignment of the print heads in relation to each other.

The print heads can be displaced transversely to the printing direction. In this way, the alignment transversely to the printing direction is disengaged from the alignment in the print direction, so that the alignment process as a whole is simplified.

In accordance with another preferred embodiment of the present invention, the print heads can each be pushed along an axis which forms an acute angle with respect to the printing direction. A resultant offset of the print heads in the printing direction can be compensated for by a corresponding change of the time of the shot from the respective print head. In connection with obliquely placed print heads in particular, i.e. print heads each of whose print nozzle row was placed obliquely in relation to the printing direction in order to permit a closer arrangement of the print heads in relation to each other, the displacement of the print heads can take place in a direction which is parallel with the oblique position, i.e. in a direction parallel in relation to the longitudinal orientation of the print heads and as defined by the row of printing nozzles. Because of such an oblique placement in an arrangement of the print heads in several rows, it is possible for print heads of different rows to be fastened on a mutual, obliquely placed print head holder. A displacement of the print heads can be performed in the longitudinal direction of the holder connecting the print heads.

In an advantageous manner, an adaptation of the printing grid distance in the printing direction with respect to the printing nozzle distance transversely to the printing direction can be performed by the time control of the individual nozzle shots as a function of the printing speed.

The alignment can be achieved, in an advantageous manner, by use of a print head positioning device for exclusively aligning the print head transversely to the printing direction, and of a shot time control device for controlling the time of the shot of the print head for aligning it in the printing direction.

The print head positioning device is preferably designed as a single-axis displacement device, by use of which the print head can be displaced along one axis. The displacement axis of the positioning device can be arranged transversely to the printing direction. In accordance with an advantageous embodiment of the present invention, the print head positioning device has a displacement axis which forms an acute angle with the printing direction. The time control device is embodied in such a way that the resultant offset of the print head in the printing direction by operation of the print head positioning device is compensated for by a change of the time of the shot, i.e. by a change in the time at which the respective print head shoots the individual drops.

In a further development in accordance with the present invention, the device has a plurality of print head positioning devices for use in aligning several print heads in relation to each other. The print heads are preferably adjustable individually and separately from each other. The control device can be designed in such a way that the shot time of the print heads can be set for each print head individually and/or for print heads in groups.

Advantages of the plurality of nozzles rest, in particular, in that the entire width of the material, and in particular of a printing plate, can be imprinted without it being necessary to move the print heads during the printing process.

An adjustment of the printing area transversely to the printing movement of the individual print heads is required only once. Setting of the printing resolution is performed by varying the angle of the nozzle rows in respect to the movement of the material to be printed.

A problem-free expansion, which is, in theory, unlimited, is possible at any time because of the modular structure. The compact structure of the printing device in accordance with the present invention is made possible by employing print heads without their own ink reservoir, or because of the special arrangement of the print head. Because of this arrangement of the print heads, the use of the circumferential angle around a cylinder is very little.

The use of standard ink jet print heads of narrow width, as well as the production in small series because of the use of level holders on which the print heads are fastened, have a cost-saving effect.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
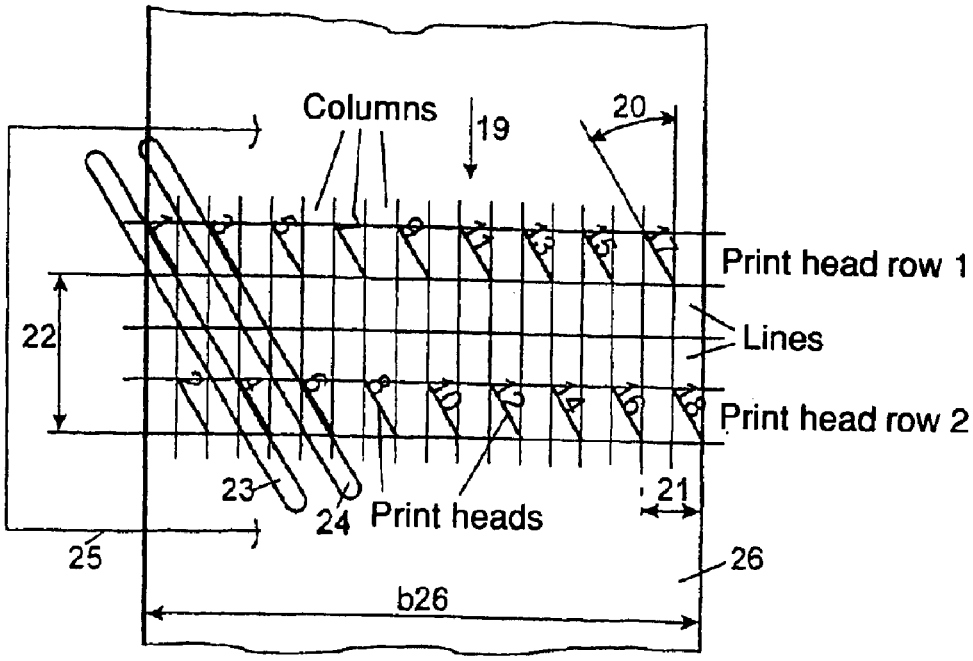
FIG. 1, a schematic representation of an arrangement of the print heads of a printing device in two rows in accordance with a first preferred embodiment of the present invention, FIG. 2, a schematic representation of the arrangement of the print heads of a printing device in three rows in accordance with a second preferred embodiment of the present invention, and in FIG. 3, a schematic representation of a multi-head ink jet printing system in accordance with the present invention, having an arrangement for aligning the print heads of a printing system.

The printing device in accordance with FIG. 1 contains eighteen individual print heads, schematically represented at 1 to 18, and which are arranged in two rows of print heads. The two rows of print heads extend spaced apart and parallel with each other, and each are generally perpendicular to a printing direction 19 indicated by the arrow.

All of the individual print heads 1 to 18 are each placed obliquely, at an angle of inclination 20 in respect to the printing direction 19, in order to achieve greater resolution. Because of the oblique placement of the individual print heads 1 to 18, it is possible to arrange the plurality of print heads 1 to 18 more closely in respect to each other. The distance of individual nozzle openings of the individual print heads 1 to 8 from each other transversely in relation to the printing direction can be reduced. As FIG. 1 shows, the angle of inclination 20 is defined by the printing direction 19, and by the longitudinal direction of each print head 1 to 18. The longitudinal direction of each of the plurality of individual print heads 1 to 18 is defined by a line in each print head along which the nozzle openings in each one of the print heads 1 to 18 are arranged. Because of the oblique placement of the print heads, the line defined by the nozzle row of each print head 1 to 18 is provided with an extension in the printing direction 19, as well as an extension transversely to the printing direction 19. The extension of the line transversely to the printing direction 19 determines the column width of a print head 1 to 18, while the extension of the line of the row of nozzles in the printing direction 19 defines the line height of the corresponding print head 1 to 18.

The print 1 to 18 of each row of print heads are spaced apart from printing direction 19. In this case, a dividing or spacing 1 to 18 in one print head row corresponds to the column width times the number of rows. In the preferred embodiment represented in FIG. 1 this dividing or space is equal to the width of two columns:

Dividing or spacing distance 21=column width×number of print head rows

The rows print heads are also spaced apart in the printing direction 19. A row of spacing distance 22 meets the following conditions:

Row spacing distance 22=line height×(number of print head rows+1)

Thus, with two rows of print heads, as in the embodiment depicted in FIG. 1, row spacing distance 22 corresponds to three times the line height which, as mentioned, is defined by the extension of the nozzle row of a print head 1 to 18 in the printing direction 19.

In accordance with the selected arrangement of the print heads 1 to 18, each print head 1, 2, 3, 4, 5, 6, 7, 8, 9, 10, 11, 12, 13, 14, 15, 16, 17, 18, which is respectively the next print head located transversely in respect to the printing direction 19, is always located in the next row and is not arranged in the same print head row. As the numbering of the print heads 1 to 18 shows, a first print head 1 is arranged in the first print head row, while the subsequent print head 2 is arranged in the second print head row.

With this arrangement of the print heads, it is possible to advantageously provide that several print heads 1 to 18 are arranged on a common plane, so that they can be mounted on a level holder. As FIG. 1 shows, the print heads 1 and 4, the print heads 3 and 6, etc., are located on a common plane and are each mounted on a common print head holder 23, or 24.

This common plane of the nozzle openings of the print heads 1 and 4, 3 and 6, etc. is inclined at the angle of inclination 20, in respect to the printing direction 19, and extends perpendicularly to the printing plane, i.e. to the material to be imprinted. In the case of a rotating material to be imprinted, for example in the case of a printing forme of a rotating cylinder of a printing press forming the material to be imprinted, the plane is inclined in respect to the axis of rotation of the cylinder and lies in the radial direction of the cylinder.

In principle, it is possible to fasten, or arrange, the print heads 1 to 18 mounted on a print head holder 23, 24 on different sides of the latter. However, a simple and therefore a preferred arrangement is provided in that the print heads 1 and 4 mounted on a print head holder 23 are both arranged on the same side of the print head holder 23, as represented in FIG. 1.

The print head holders 23, 24 can be seated on a common support 25, which is depicted schematically in FIG. 1.

The number of print head rows is preferably selected in accordance with the space requirements. In accordance with FIG. 2, the print heads 1 to 18 can be arranged in three print head rows.

Figure 2:
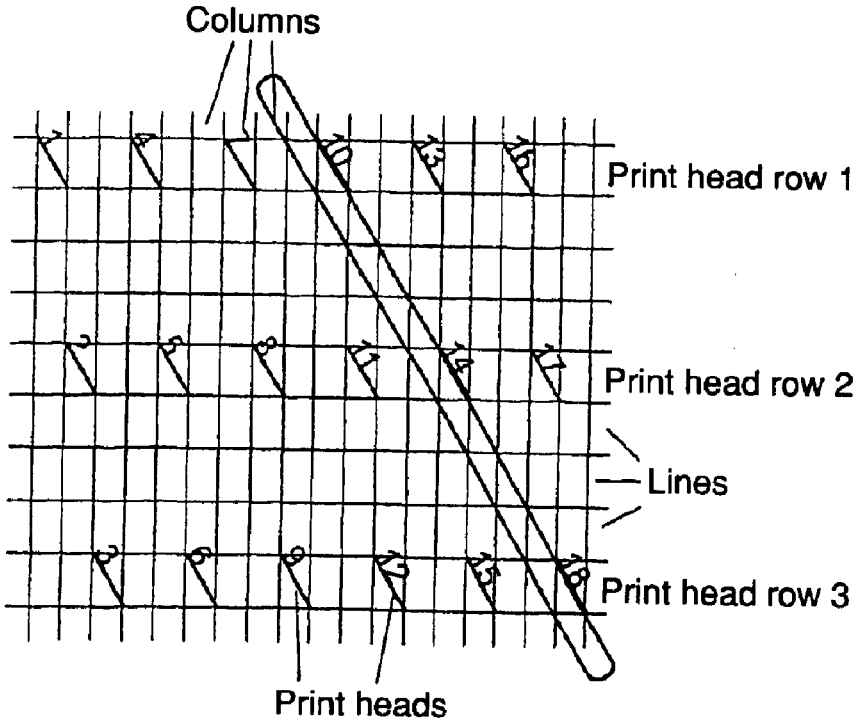

The arrangement of the print heads 1 to 18 depicted in FIG. 2 corresponds, in most respects, to the arrangement of print heads in accordance with FIG. 1. In particular, the column jumps between the print heads 1 to 18 of a print head row, as well as the line jumps, i.e. the distance between rows in the printing direction 19, correspond to the relationship described in connection with FIG. 1. In the same way, the oblique placement of the individual print heads 1 to 18 corresponds to the above mentioned connections. It is therefore believed appropriate to omit a further explanation of the arrangement in accordance with FIG. 2.

Figure 3:
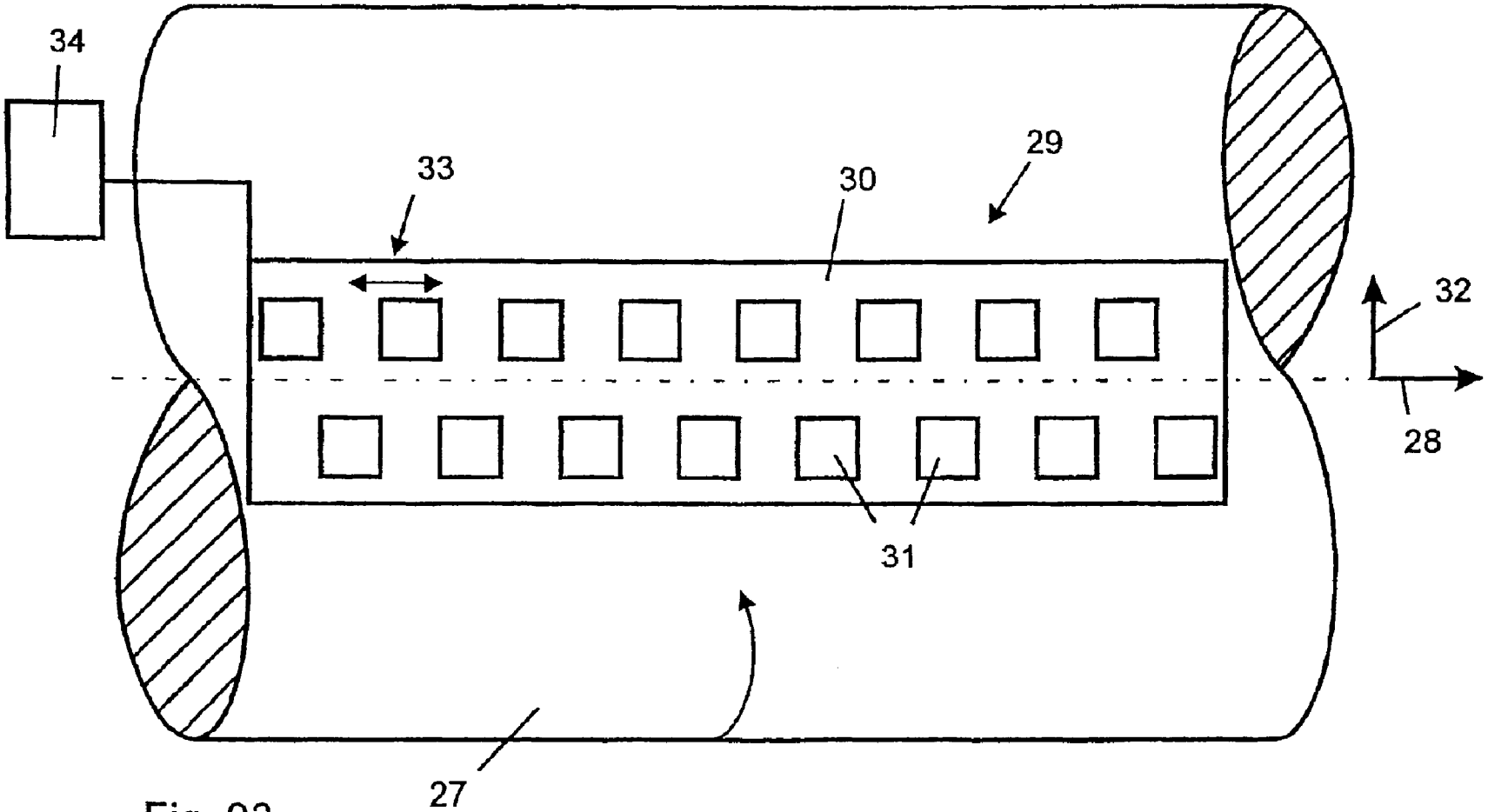

A printing plate cylinder 27, which is depicted schematically in FIG. 3, and on which a material 26 to be imprinted, which material 26 may be, for example a printing plate, and in particular which may be an offset printing plate 26 or a planographic printing plate 26, can be mounted, rotates in the usual manner around its longitudinal axis 28. A multi-head inkjet printing system 29 is provided for placing images on the printing plate 26. Multi-head inkjet printing system 29 has a printing beam 30, which beam 30 extends parallel with the longitudinal axis 28 of the printing plate cylinder 27 opposite the circumferential side of the latter.

A plurality of print heads 31 are seated on the printing beam 30, which print heads 31 are embodied as ink jet print heads and which spray a printing liquid, in drops, on the printing plate 26. The print heads 31 are arranged in two rows, wherein the print heads 31 in the two different rows are arranged offset transversely in relation to a printing direction 32 which printing direction 32 is generally perpendicular to the axial direction 28 of the printing plate cylinder 27. The printing direction 32 is determined by the rotational movement of the printing plate cylinder 27 and as previously indicated extends perpendicularly in respect to the longitudinal axis 28.

The print heads 31 are displaceably seated on the print beam 30. The print heads 31 can be displaced individually in relation to the printing beam 30 along one axis by operation of a print head positioning device 33, so that the position of each respective print head 31 is changed transversely to the printing direction 32, i.e. in a direction which is parallel with the longitudinal axis 28. The printed image can be set transversely to the printing direction by this movement of the print heads 31.

A time control device 34, which controls the shot time of the individual print heads 31, or of the individual printing nozzles, is provided for the purpose of correcting, or for aligning, the orientation of the print heads 31 in the printing direction 32.

In this way, the problem of positioning, or aligning several print heads 31 in relation to each other in a plane is simplified by the separation of the two axes to be positioned. One axis is defined by the direction in which the material to be imprinted moves. Accordingly, this axis can be aligned by use of a skillful time control of the time of the shot of the individual printing nozzles. The other axis is located transversely in respect to the printing direction 32, and in the example shown in FIG. 3 is located parallel with the longitudinal axis 28. It is therefore possible to mechanically align this axis 28 alone in a simpler way.

Although the preferred embodiment describes the printing system in terms of the placement of images on printing plates, the described alignment arrangement can also be used in other print head printing systems for different printing applications in which the position of the print heads 33 must be aligned.

The print heads 1 to 18, and specifically their nozzle openings, extend over the entire width b26 of a material 26 to be imprinted, as seen in FIG. 1. During printing of material 26, the print heads 1 to 18 are stationary. They can only be moved for aligning the print heads 1 to 18 is relation to each other, or for increasing the resolution.

A variation of the printing resolution is possible by use of several image applications. Matching transversely to the printing direction is performed by the displacement of the printing head at a time between printing processes by a whole number fraction of an image point distance of the basic resolution, which distance lies approximately at $5\mu$ and $50\ \mu$m, so that the printing grids are offset in respect to each other. Matching of the printing resolution in the direction of movement of the material to be printed is performed by an appropriate matching of the time control of the shot time.

Therefore the print heads are offset in the axial direction of the cylinder, in particular following a first revolution of the cylinder, preferably the entire printing beam 30 is laterally displaced.

The above-described printing device preferably imprints material 26, which is arranged curved on a cylinder.

In this case, the printing device can also be utilized for changing the coating or for coating a printing forme 26, wherein the printing forme 26 is embodied as a planographic plate 26.

The planographic printing plate 26 can have an ink-absorbing layer, and an ink-repelling layer placed on it. Corresponding to the image to be printed, the printing device will apply a developing fluid to the ink-repelling layer, by which the ink-repelling layer is changed in the charged areas.

For waterless offset printing, the printing plate 26 is embodied with an ink-repelling layer of silicon.

Preferably, each print head has 64 to 256 nozzle openings, wherein the nozzle openings of a print head are arranged on a straight line.

While preferred embodiments of a printing device with a plurality of print heads, and a method for using a printing device in accordance with the present invention have been set forth fully and completely hereinabove, it will be apparent to one of skill in the art that a number of changes in, for example, the overall configuration of the printing press, the actual number of print heads, and the like could be made without departing from the true spirit and scope of the present invention which is accordingly to be limited only by the scope of the following claims.

What is claimed is:

1. A printing device comprising:

a plurality of print heads, said plurality of print heads forming at least first and second parallel rows of print heads, said print heads in each of said at least first and second rows being spaced from each other in each of said rows, said print heads in said first row being offset transversely, in a running direction of a material to be printed, to said print heads in said second row;

a plurality of nozzle openings in each of said plurality of print heads; and means for selectively positioning each of said plurality of print heads in each of said at least first and second rows in at least first and second positions that are located spaced from each other in a respective one of said at least first and second rows in a direction extending transversely to the running direction of a material to be printed, said plurality of print heads each being arranged stationary during printing, said at least two positions for each said print head being separated by a spacing distance, said spacing distance being no greater than $50\ \mu$m.

2. The device of claim 1 wherein said printing device is adapted to apply a coating changing material to a printing forme, said printing forme being the material to be printed.

3. A method of printing comprising:

providing a plurality of print heads;

providing a multiplicity of nozzle openings in each of said print heads;

arranging said plurality of print heads in at least first and second parallel rows;

spacing said plurality of print heads in each of said at least first and second rows spaced apart from each other in each of said rows;

offsetting said print heads in said first row with respect to said print heads in said second row;

supporting each of said print heads in each of said at least first and second rows for selective positioning in a least two positions, said at least two positions being located spaced from each other transversely to a direction of running of a material to be printed;

holding said print heads stationary during a printing process; and increasing a resolution during said printing process by locating said at least two positions at a spacing distance no greater than $50\ \mu$m.

4. The method of claim 3 further including providing said material to be printed as a printing forme having a coating and using said printing heads for applying a coating changing material to said coating of said printing forme.

5. The method of claim 3 further including providing a printing area on each of said printing heads, using an extension of said printing area in a printing direction to fix a line height, using an extension of said printing area transverse to said printing direction to fix a column width, and arranging said print heads in said at least first and second parallel rows spaced from each other, arranging print heads in each of said at least first and second parallel rows offset transversely to said printing direction from print heads in others of said at least first and second parallel rows, determining a dividing distance of print heads in each row by multiplying said column width by a number of said rows, and determining a dividing distance of said rows by multiplying said line height by said number of rows plus one.

6. The method of claim 3 further including locating said plurality of print heads from each of said at least first and second rows in common planes.

7. The method of claim 3 further including providing each said print head with a longitudinal direction determined by its nozzle openings position, and arranging said longitudinal direction obliquely with respect to said printing direction.

8. The method of claim 3 further including providing each said print head with a longitudinal direction and arranging said print heads from different ones of said at least first and second rows so that said longitudinal direction of said arranged print heads lie in a common plane.

9. The method of claim 3 further including providing print head holders and supporting said plurality of print heads on said print head holders arranged in said at least first and second parallel rows, and arranging said print head holders having at least one level surface.

10. The method of claim 3 including a time control device for controlling a shot time of each one of said print heads for affecting an alignment of each said print head in a printing direction and further including a print head positioning device for aligning at least one print head relative to another print head transversely to said printing direction.

11. The method of claim 10 wherein said print head positioning device is a single-axis displacement device.

12. The method of claim 11 wherein said print head positioning device has a displacement axis transverse to said printing direction.

13. The method of claim 12 including providing said print head positioning device having a displacement axis extending at an acute angle to the printing direction and said time control device compensating for an offset resulting in said print head in said printing direction by changing a shot time of said print head.

14. The method of claim 13 including providing several print head positioning devices for aligning several of said print heads in relation to each other and providing said time control device for setting shot times of said print heads selectively, individually and in groups.

15. A method for using a printing device including:

providing a plurality of print heads in said printing device;

providing a plurality of nozzle openings in each one of said plurality of print heads;

arranging said plurality of print heads in at least first and second parallel rows;

offsetting said print heads in said first row with respect to said print heads in said second row;

supporting each of said print heads in each of said at least first and second rows for selective positioning in at least two positions;

selecting each of said at least two positions spaced from each other transversely to a direction of running of a material to be printed;

providing a printing plate having an ink absorbing layer and an ink-repelling layer;

using said printing device for applying a developing fluid on an area of said ink-repelling layer corresponding to an image to be printed during a printing process;

changing said ink-repelling layer in said area contacted by said developing fluid; and holding said print heads stationary during said printing process.

16. The method of claim 15 further including providing a printing area on each of said printing heads, using an extension of said printing area in a printing direction to fix a line height, using an extension of said printing area transverse to said printing direction to fix a column width, and arranging said print heads in several parallel rows spaced from each other, arranging print heads in each of said several parallel rows offset transversely to said printing direction from print heads in others of said several parallel rows, determining a dividing distance of print heads in each row by multiplying said column width by a number of said rows, and determining a dividing distance of said rows by multiplying said line height by said number of rows plus one.

17. The method of claim 15 further including arranging print heads in a plurality of rows and locating print heads from each of said plurality of rows in common planes.

18. The method of claim 15 further including providing each said print head with a longitudinal direction determined by its nozzle openings position, and arranging said longitudinal direction obliquely with respect to said printing direction.

19. The method of claim 15 further including arranging said print heads in several rows, providing each print head with a longitudinal direction and arranging said print heads from different ones of said several rows so that said longitudinal direction of said arranged print heads lie in a common plane.

20. The method of claim 15 further including providing print head holders and supporting said plurality of print heads on said print head holders arranged in several different rows, and arranging said print head holders having at least one level surface.

21. The method of claim 15 including a time control device for controlling a shot time of each one of said print heads for affecting an alignment of each said print head in a printing direction and further including a print head positioning device for aligning at least one print head relative to another print head transversely to said printing direction.

22. The method of claim 21 wherein said print head positioning device is a single-axis displacement device.

23. The method of claim 22 wherein said print head positioning device has a displacement axis transverse to said printing direction.

24. The method of claim 23 including providing said print head positioning device having a displacement axis extending at an acute angle to the printing direction and said time control device compensating for an offset resulting in said print head in said printing direction by changing a shot time of said print head.

25. The method of claim 24 including providing several print head positioning devices for aligning several of said print heads in relation to each other and providing said time control device for setting shot times of said print heads selectively, individually and in groups.

* * * * *